US009468827B2

(12) United States Patent
Ling

(10) Patent No.: US 9,468,827 B2
(45) Date of Patent: Oct. 18, 2016

(54) FOOTBALL ACCESSORY FOR DOWNING THE BALL CARRIER

(71) Applicant: Depingo, LLC, St. Paul, MN (US)

(72) Inventor: Jeremy J. Ling, St. Paul, MN (US)

(73) Assignee: Depingo, LLC, St. Paul, MN (US)

( * ) Notice: Subject to any disclaimer, the term of this patent is extended or adjusted under 35 U.S.C. 154(b) by 0 days.

(21) Appl. No.: 14/578,570

(22) Filed: Dec. 22, 2014

(65) Prior Publication Data

US 2015/0190694 A1 Jul. 9, 2015

Related U.S. Application Data

(60) Provisional application No. 61/964,517, filed on Jan. 7, 2014.

(51) Int. Cl.

| | |
|---|---|
| ***A63B 69/00*** | (2006.01) |
| ***A63B 67/00*** | (2006.01) |
| *A63B 71/06* | (2006.01) |
| *A63B 69/34* | (2006.01) |

(52) U.S. Cl.

CPC ..... *A63B 67/002* (2013.01); *A63B 69/002* (2013.01); *A63B 71/0605* (2013.01); *A63B 71/0608* (2013.01); *A63B 69/00* (2013.01); *A63B 69/0059* (2013.01); *A63B 69/345* (2013.01); *A63B 71/0622* (2013.01); *A63B 2071/0625* (2013.01); *A63B 2071/0694* (2013.01); *A63B 2207/02* (2013.01); *A63B 2209/10* (2013.01); *A63B 2243/007* (2013.01)

(58) Field of Classification Search

CPC .. A63B 67/00; A63B 69/00; A63B 69/0059; A63B 67/002; A63B 47/001; A63B 69/002; A63B 2243/007; A63B 69/345

USPC ..... 473/438, 422, 450, 458, 464, 502

See application file for complete search history.

(56) References Cited

U.S. PATENT DOCUMENTS

| | | | | |
|---|---|---|---|---|
| 3,484,974 | A | 12/1969 | Culmone | |
| 4,433,803 | A * | 2/1984 | Liberboim | A63B 47/001 224/251 |
| 4,441,211 | A * | 4/1984 | Donzis | A41D 13/0153 2/459 |
| 4,706,860 | A * | 11/1987 | Leider | A63B 47/001 224/247 |
| 4,852,782 | A * | 8/1989 | Wu | A63B 53/02 473/299 |
| 5,938,549 | A | 8/1999 | Schenkenfelder | |
| 5,947,352 | A * | 9/1999 | Parsons | A45F 3/14 224/250 |
| 6,004,232 | A | 12/1999 | Sennott | |
| 6,610,032 | B1 * | 8/2003 | Prody | A61M 27/00 604/179 |
| 6,993,940 | B2 * | 2/2006 | Rabinowicz | A41D 13/0015 2/250 |
| 8,152,659 | B1 * | 4/2012 | Wadley | A63B 47/001 473/438 |
| 2009/0042675 | A1 | 2/2009 | Baun, II et al. | |
| 2010/0323824 | A1 | 12/2010 | Gamboa | |

FOREIGN PATENT DOCUMENTS

| | | |
|---|---|---|
| DE | 10048149 | 4/2002 |
| WO | WO 94/02040 | 2/1994 |

* cited by examiner

*Primary Examiner* — Mitra Aryanpour
(74) *Attorney, Agent, or Firm* — Merchant & Gould P.C.

(57) ABSTRACT

An apparatus for use in an American football type game includes an elongate structure defining a generally tubular body having a length extending between two opposing ends, a width, and a handgrip portion located between the ends. The width of the tubular body is generally uniform along the entire length of the body. An attachment mechanism removably receives the elongate structure at an attachment point and limits movement of substantially the entire elongate structure to that of the attachment mechanism at the attachment point. The attachment mechanism is configured to release the elongate structure therefrom when a force that overcomes an attachment force provided by the attachment mechanism is applied to the handgrip portion.

13 Claims, 10 Drawing Sheets

FOOTBALL ACCESSORY FOR DOWNING THE BALL CARRIER

BACKGROUND

Modern research and studies are raising significant concerns over the long-term health consequences that can result from sports concussions and other types of play-related head injuries. As the concerning evidence mounts, American tackle football has become the topic of considerable controversy. Dangerous collisions/injuries can happen accidentally in any sports, however in tackle football the risk factors are significantly higher since collisions are an intentional rather than accidental part of the game. In American tackle football, the primary method of downing the ball carrier is by tackling the ball carrier to the ground, which inherently results in collisions. The magnitude and repetition of these collisions can cause concussions and head injury.

Research is showing that it's not always just one large collision that leads to injury, but even repetitive smaller collisions that can make the brain more susceptible to injury over time. This is concerning, since tackle football players experience repetitive collisions as part of the games, practices, and drills. In regards to youth football, there are some further unique concerns. Youngsters are not miniature adults. For starters, their brains are not yet fully myelinated, meaning nerve cells in the brain lack the complete coating that offers protection. This makes youth more susceptible to concussions, and also means they recover more slowly from them compared to adults. Children have big heads relative to the rest of their bodies and weak necks, creating a "bobblehead effect" that elevates the risk of concussion. Kids typically play in the oldest equipment, with the least educated coaches, and with little or no available medical care. And finally, kids are unable to provide meaningful informed consent. Rarely do kids really understand the situations and risks they're putting themselves in.

Flag football is an alternative to tackle football. However, most football enthusiasts would view flag football as an inferior version of the game. In Flag football, there is no tackling. Instead, all players wear one or more flags that, when removed from a ball carrier, indicates that the ball carrier is down, thereby signifying the end of that play. The flags are typically flat, narrow strips of nylon or fabric. One end of the flag is normally releasably secured to a belt worn around the player's waist. A hook-and-loop (i.e., VELCRO®) type attachment is a common means to secure one end of the flag to the player. The other end of the flag hangs freely down toward the players knees. As the players run, the flag is free to bounce, move, and flutter around (as the name "flag" would suggest). The flag therefore has its own movements independent from the ball carrier. This dynamic, independent motion of the flag makes it difficult to grab the flag even if a player has a good position or grip on the ball carrier. In fact, often it takes a bit of luck to grab the flag. For example, players can be in what's considered a good defensive position to down the ball carrier, but the elusiveness of the flag allows the ball carrier to escape and continue advancing the ball. This attribute makes flag football a unique sport to defend. In tackle football, defensive players are taught to focus on a ball carrier's movements (specifically the torso) when tracking and downing the ball carrier. Many other sports and games similarly share this common ingredient, whereby defense has to watch and interpret movements of opposing players in order to make a defensive stand. Flag football is distinctly unique, in that defensive emphasis is placed on movements of an independently moving flag instead of movements of a player. Many football and sports enthusiasts alike do not care for this non-conventional emphasis.

In flag football, the flags generally attach approximately at the player's waistline, and the flags hang freely down toward the player's knee region. This attachment location is not ideal for head safety. Even though there's no tackling in flag football, the low flag positioning often results in players lowering their heads to make a play for the flag. Any time players are lowering their heads to reach for a flag, it is creating a dangerous situation in terms of head injuries. For example, accidental collisions between a ball carrier's knee and a defender's head can be very dangerous in terms of concussions and head injuries. Positioning flags on the lower body (waist down) is a poor location, as it requires players to lower their body and head to make a play for the flag, which puts players' heads at risk of experiencing collisions.

Furthermore, the flag is a flat strip of fabric, or the like, with very minimal thickness. Flag length is often around 12-16 inches. Flag width is typically around 1.5 inches. And, flag thickness is typically only around 0.062 inches (typical fabric thicknesses). This slim thickness profile along with the fabric type construct can make the flags difficult to distinguish or grab, as they can easily slip out of the defenders' hands. Essentially, flags are not ergonomically designed to be grasped by a hand, as they lack any sort of grab features or dimensions. Therefore, the flag construction and profile further adds to the luck factor in downing the ball carrier. For many American football enthusiasts, the emphasis on a flag rather than a player, combined with the proportion of luck versus skill in downing the ball carrier is unappealing for flag football.

With the growing awareness and evidence associating tackle football with head injuries, concussions, and long term health implications, there exists a need for alternative ways to down the ball carrier. Specifically the alternative means of downing the ball carrier should avoid tackling, thereby minimizing collisions associated with head injuries and concussions. Furthermore, downing the ball carrier should encourage upright play, such that players don't have to reach low to down the ball carrier, thereby lowering and exposing their heads to dangerous situations. Furthermore, there exists a need for alternative ways of downing the ball carrier that reward good defensive positioning, and minimizes the luck factor in downing the ball carrier. Furthermore, there exists a need for alternative ways of downing the ball carrier that preserve conventional defensive focus on a player's movements, rather than arbitrary movements of an accessory.

SUMMARY

Generally the disclosure is directed to an accessory worn by American football players. The accessory includes a removable component(s), which hereinafter will be referred to as a "Tackle-Bar." A Tackle-Bar may be an elongated structure configured for attachment to a player's body. The accessory may also include a belt, harness, or the like, to facilitate removable attachment of the Tackle-Bar(s) to the player's body. Alternatively, jerseys or uniforms may include attachment provisions for connecting the Tackle-Bar(s) to a player's body. The Tackle-Bar's construction and attachment mechanism are configured to limit independent motion of the Tackle-Bar thereby constraining the Tackle-Bar to move in unison with the player. This attribute preserves conventional defensive emphasis, requiring defensive focus on movements of the ball carrier, rather than diverting attention to arbitrary, independent movements of an accessory. When the Tackle-Bar is removed from the ball carrier, this signifies the ball carrier is down and the play is over. Removal of the Tackle-Bar is intended to therefore be an alternative way of downing the ball carrier thereby avoiding the collisions associated with tackling. The accessory could be utilized in all the various types of football games, including padded, non-padded, and, for example, as an improvement to conventional flag football. The Tackle-Bar may take form in various lengths and shapes, but is generally dimensioned and constructed to be easily graspable and distinguishable when worn on a player's body.

DESCRIPTION OF THE DRAWINGS

Drawings of some embodiments of the apparatus are included to assist in explaining the basic inventive ideas. These drawings are intended as illustrations and are not meant to limit the inventive aspects described herein.

DETAILED DESCRIPTION

The subject matter described herein may take form in a variety of embodiments, including but not limited to, the embodiments, components, arrangements of components, assembly methods and arrangements of methods, and apparatus usage procedures and arrangements of procedures as described below. The embodiments described, while possibly being preferred embodiments, are illustrative examples and are not meant to limit the inventive aspects described herein.

Figure 1:
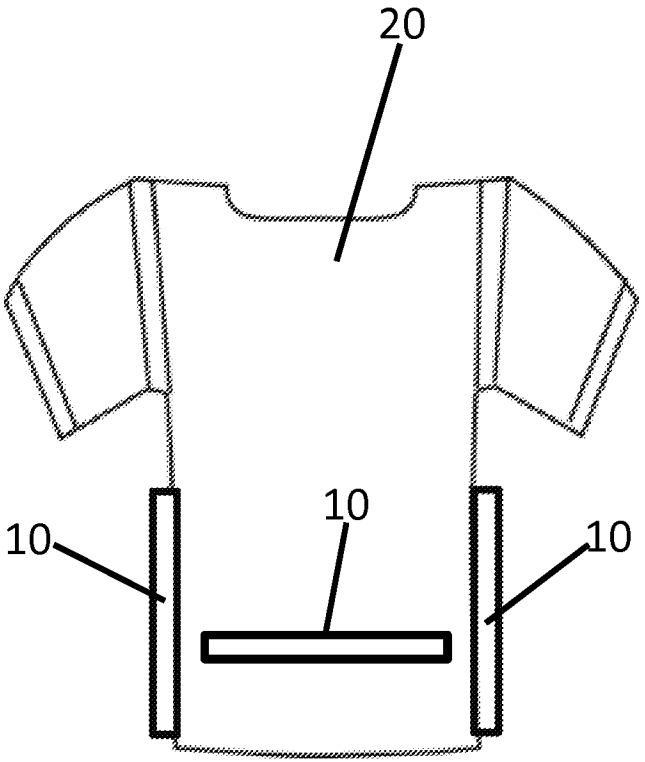
FIG. 1: A football uniform/jersey outfitted with Tackle-Bars having inventive aspects in accordance with the present disclosure.

FIG. 1 illustrates a football jersey 20 including three elongated structures, referred to as Tackle-Bars 10, releasably attached to the jersey 20. A defensive player must grab and remove one of the Tackle-Bars 10 from the jersey to down the ball carrier and end the play. In FIG. 1, one of the Tackle-Bars 10 is shown as attached laterally across the lower back area. The other Tackle-Bars 10 are located on each side of the jersey 20, extending vertically upward from the hip region toward the arm pits. The Tackle-Bars 10 may be attached in various positions and quantities on a player's body, preferably on a player's torso between the waist and shoulders. This upper body positioning encourages heads-up play, such that defensive players are not lowering their heads into dangerous positions while attempting to remove a Tackle-Bar 10. In the embodiment of FIG. 1, a defensive player would have to target the side or back of the ball carrier to remove a Tackle-Bar 10, thereby reducing incidents of direct collisions.

According to one embodiment, the Tackle-Bar may be an elongated structure that is made from a soft material, such as foam, rubber, silicone, or the like. A soft, compliable material ensures that the Tackle-Bar will not cause pain or injury if a player falls or lands on the Tackle-Bar.

Figure 2A:
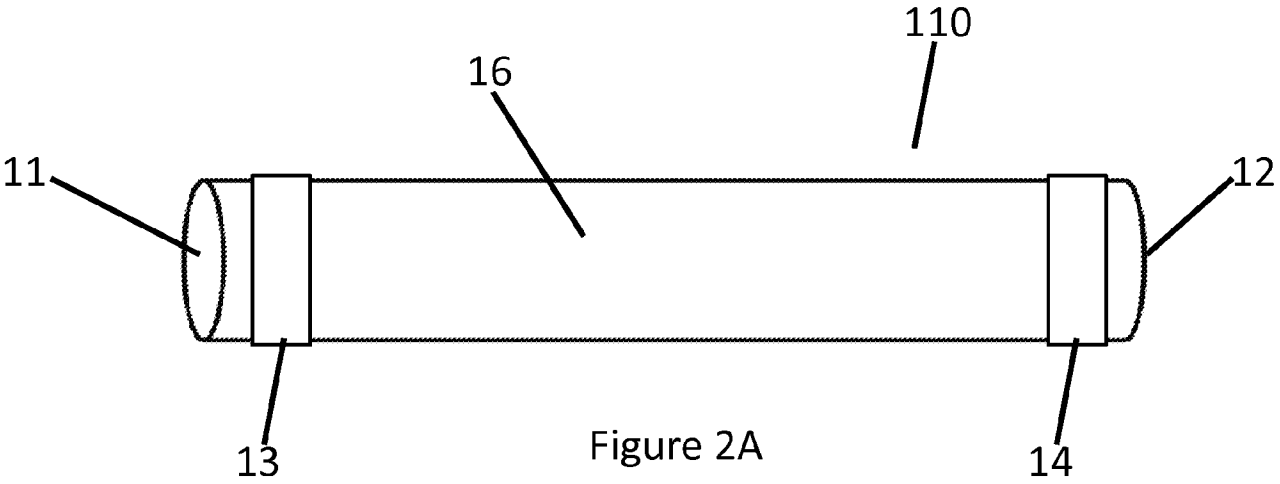
FIG. 2A: A perspective view of a cylindrical Tackle-Bar with two attachment features in accordance with the present disclosure.
Figure 2B:
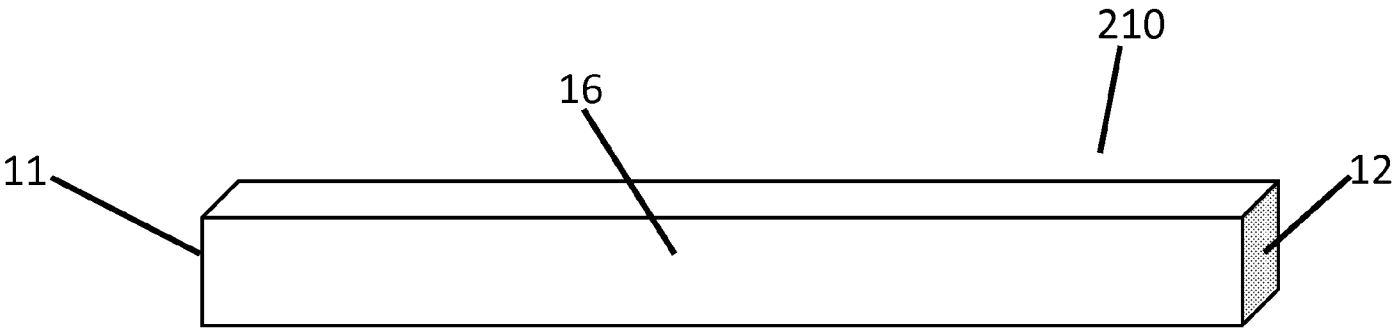
FIG. 2B: A perspective view of a rectangular Tackle-Bar in accordance with the present disclosure.

FIG. 2A illustrates a cylindrical shaped Tackle-Bar 110 defined by an elongated cylindrical body 16 with opposing ends 11 and 12. The length of the Tackle-Bar can vary, but generally the distance between opposing ends 11 and 12 of the elongated structure should be at least great enough to accommodate a single hand grab during removal. In the embodiment of FIG. 2A, the cylindrical body 16 of the elongated structure may function as a handgrip. The body 16 provides appropriate form, size, and shape to be easily and intuitively grasped by a single hand during removal. In other embodiments, the shape of the Tackle-Bar can take on a variety of other forms, such as the rectangular version of the Tackle-Bar 210 illustrated in FIG. 2B. Regardless of the configuration, the various forms, sizes, and shapes of the Tackle-Bar elongated structure should preferably always include a handgrip region appropriately constructed for a single-handed grasp. Furthermore, the Tackle-Bar design should position the handgrip region such that it protrudes from the player, so that it can be easily distinguished during removal. Thin cross sections or fabric like shapes would not be desirable for a Tackle-Bar, as they lack a handgrip region, making them hard to grasp and distinguish. Furthermore, thin cross sections or fabric like shapes would tend to blend in with a players body and uniform, rather than protruding therefrom, making removal difficult and unpractical at game speeds. For these reasons, it is fundamental that the Tackle-Bar design and construction presents an easily graspable region that protrudes or extends from the player's body.

Figure 2C:
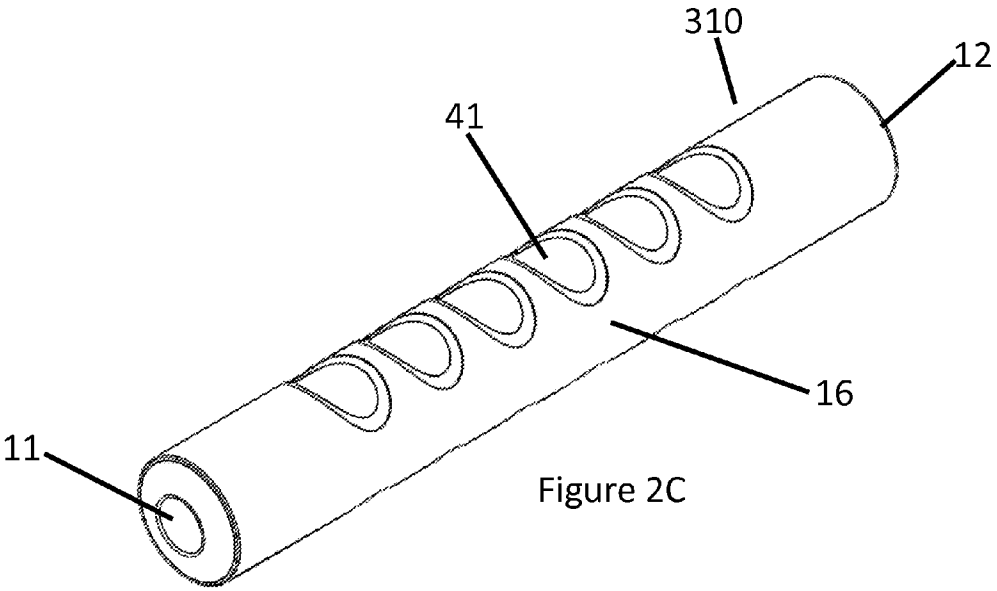
FIG. 2C: A perspective view of another embodiment of a Tackle-Bar with finger grip features.

In other embodiments, such as shown in FIG. 2C, the hand grip region 16 of the Tackle-Bar 310 may even include various features, like finger grips 41 that further provide distinction and tactile feedback in grabbing the Tackle-Bar during removal.

There may be various methods and structures for providing releasable attachment of the Tackle-Bar(s) to a player. The releasable connection must be robust enough to maintain Tackle-Bar attachment to the body while a player runs, jumps, and engages in the various physical motions associated with the game. Conversely, the attachment mechanism must allow release of the Tackle-Bar from the player when the Tackle-Bar is grabbed by a defensive player. Furthermore, re-attachment of the Tackle-Bar must be easy, efficient, and reliable.

FIG. 2A illustrates the Tackle-Bar 110 with a hook-and-loop (i.e., VELCRO®) type attachment. The Tackle-Bar 110 includes hook-and-loop type fasteners 13 and 14 near each opposing end 11 and 12 of the Tackle-Bar 110.

Figure 2D:
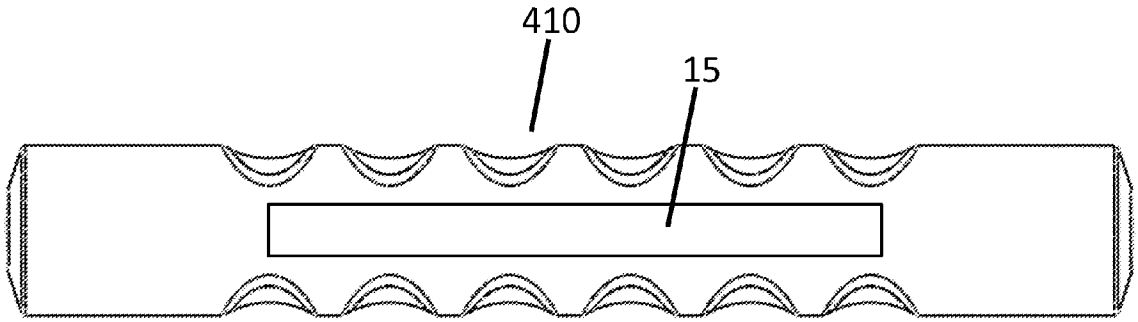
FIG. 2D: A Tackle-Bar similar to that shown in FIG. 2C with a single attachment feature.

FIG. 2D illustrates a Tackle-Bar 410 similar to the Tackle-Bar 310 shown in FIG. 2C with a hook-and-loop type fastener 15 that extends substantially along the length of the Tackle-Bar 410. In both FIGS. 2A and FIG. 2D, a mating piece or pieces of hook-and-loop fastener(s) would be incorporated into the player's uniform to releasably attach the Tackle-Bar(s) to the player's body. Hook-and-loop fasteners provide an economical and efficient mechanism for creating the releasable attachment. Many other releasable connection methods will be obvious to those skilled in the art, for example snaps, clips, buttons, and the like. It is fundamental that the Tackle-Bar construction, along with its attachment provisions, substantially limit motion of the Tackle-Bar independent of the player's motion. For example, the Tackle-Bar 110 in FIG. 2A includes attachment fasteners 13 and 14 strategically placed near each opposing end 11 and 12. In this manner, when attached to a player, the entire elongated structure of the Tackle-Bar is constrained to move in unison with the player. This is an important attribute because defensive fundamentals require reacting to movements of a ball carrier. For example, if the Tackle-Bar 110 in FIG. 2A only included an attachment provision located near one end, the opposing end of the Tackle-Bar 110 would be free to bounce, move, and flutter around as the ball carrier moves, similar to the motion of a conventional flag. Such motion of the Tackle-Bar would be undesirable because it would require a defensive player to react to movements of the accessory rather than movements of the ball carrier, thereby eroding fundamentals of playing defense.

FIG. 2D includes a version with a single attachment fastener 15 or a single attachment point, but the attachment point substantially extends along a majority of the length of the Tackle-Bar 410 to substantially prevent movement of the Tackle-Bar 410 independent of the movement of the player wearing it. The general combination of provisions that work together to prevent motion of the Tackle-Bar independent of the player include a Tackle-Bar material with adequate stiffness or rigidity to resist independent motion, regardless of where or how many attachment points there are with respect to the player, and/or at least two points of attachment between the Tackle-Bar and player, and/or a single point of attachment that is substantially large/long enough to hold the Tackle-Bar from independent movement. In this manner, Tackle-Bars are significantly integrated with the player's body and the player's movements. This attribute enables a defensive player to focus on and react to the ball carrier's movements, rather than reacting to independent motion of an accessory. This preserves many of the defensive fundamentals of the game, and minimizes the luck factor in removing the Tackle-Bar.

As noted above, FIG. 1 illustrates Tackle-Bars 10 attached to a jersey. There are many other alternative ways to attach the Tackle-Bars to players besides connecting with a jersey. For example, Tackle-Bar(s) could be attached to the waistline of shorts or pants. In another embodiment, suspenders could be fashioned to provide an upper body harness for releasably connecting the Tackle-Bar(s).

Figure 3A:
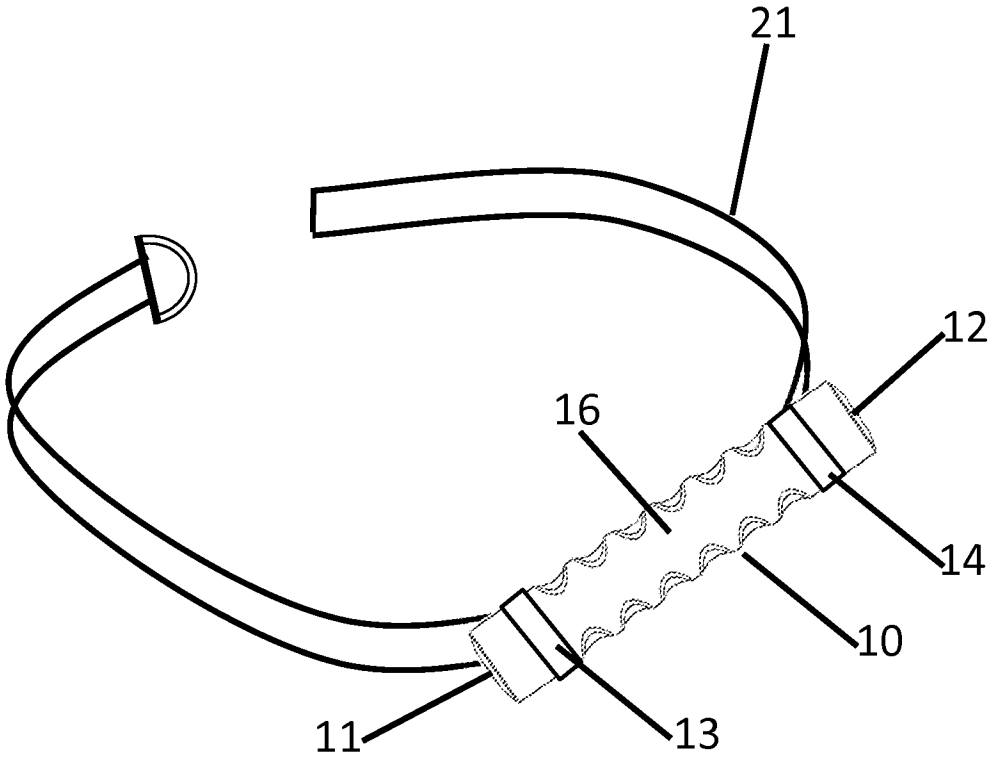
FIG. 3A: A perspective view of a belt that can be worn around a player's torso, the belt including a cylindrical Tackle-Bar similar to those shown in FIGS. 2C and 2D but with two attachment features adjacent the ends of the Tackle-Bar.

FIG. 3A illustrates a Tackle-Bar 10 that is releasably attached to a belt 21 via attachment fasteners 13 and 14. The belt 21 can be worn around the waistline, like a conventional belt, or alternatively could be located around the upper body at various positions between the waist and armpits. The belt 21 can be made of an elastic stretch material to help comfortably secure it around the player's waist or torso.

Figure 3B:
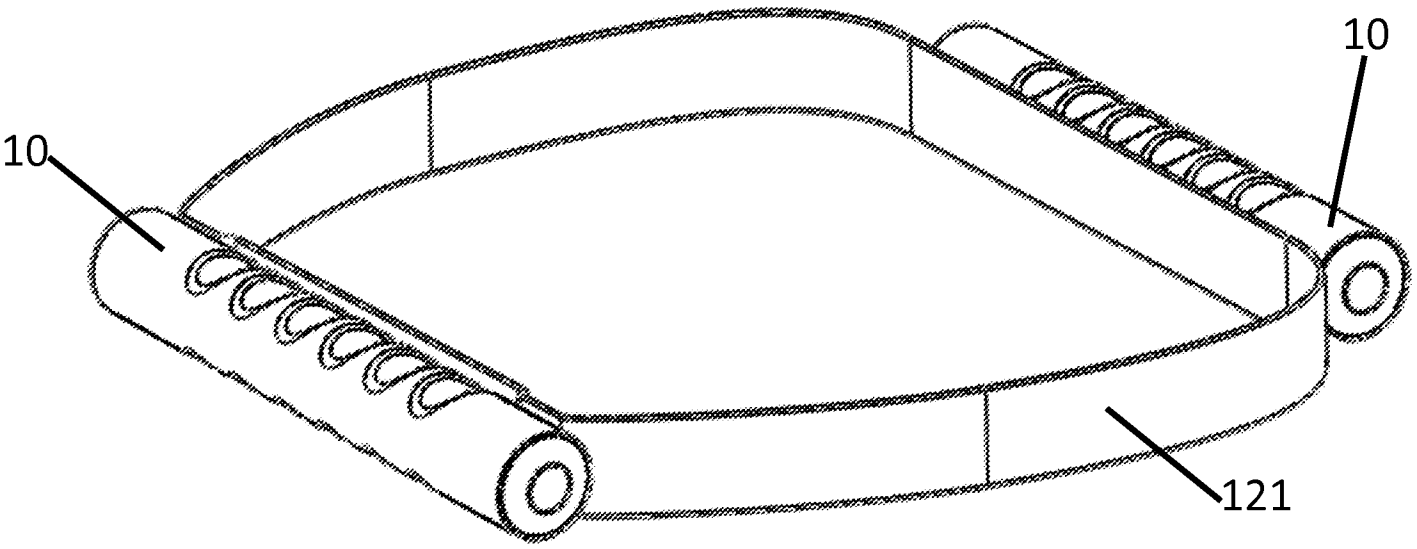
FIG. 3B: A perspective view of a belt similar to that shown in FIG. 3A with two cylindrical Tackle-Bars attached thereto.

FIG. 3B similarly illustrates a belt 121 that is configured to receive two Tackle-Bars. In this embodiment, for example, one Tackle-Bar could be located on the front of the player, while another is located on the back of the player. Alternatively, as another example, the belt 121 in FIG. 3B could be utilized to position a Tackle-Bar on each side of the player, for example in the hip vicinity.

Figure 4A:
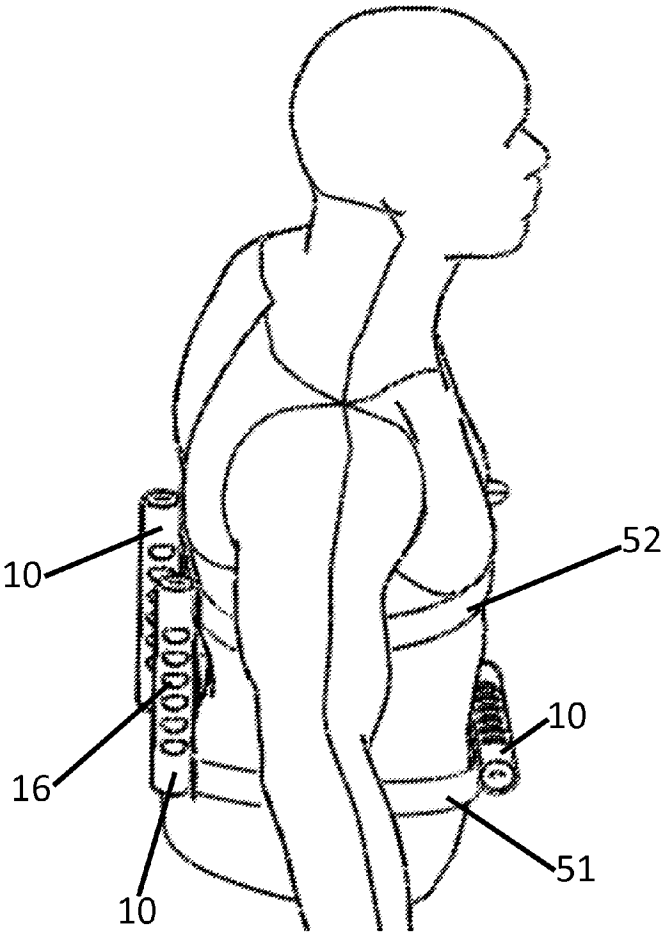
FIG. 4A: A perspective view of a wearable harness configured to receive a plurality of Tackle-Bars.
Figure 4C:
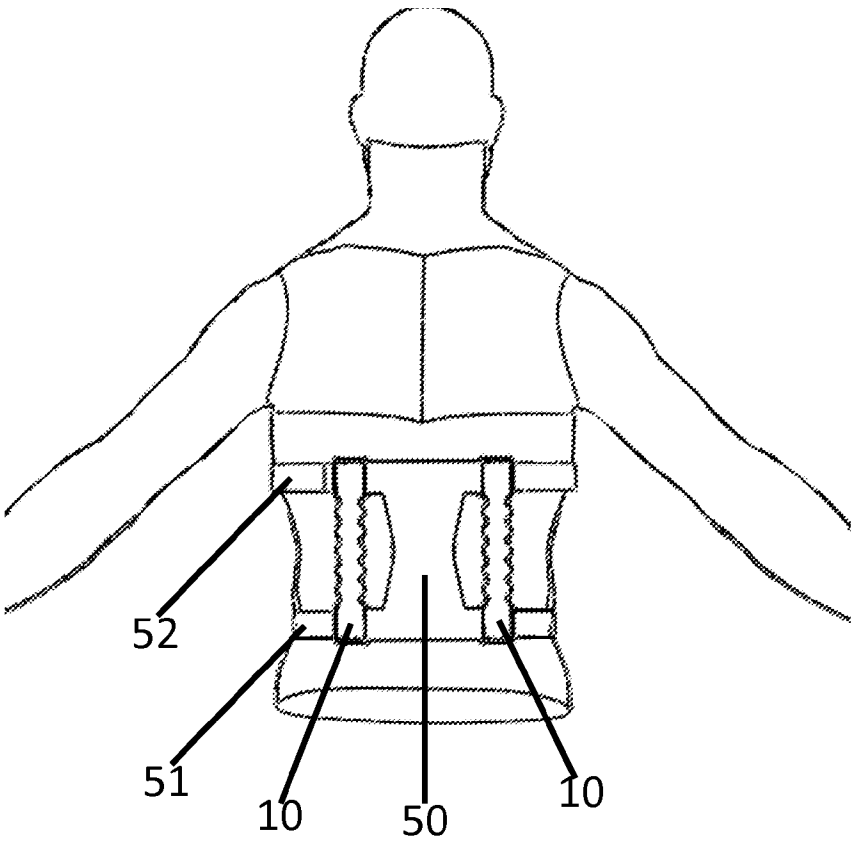
FIG. 4C: A back view of the wearable harness shown in FIGS. 4A and 4B.
Figure 4B:
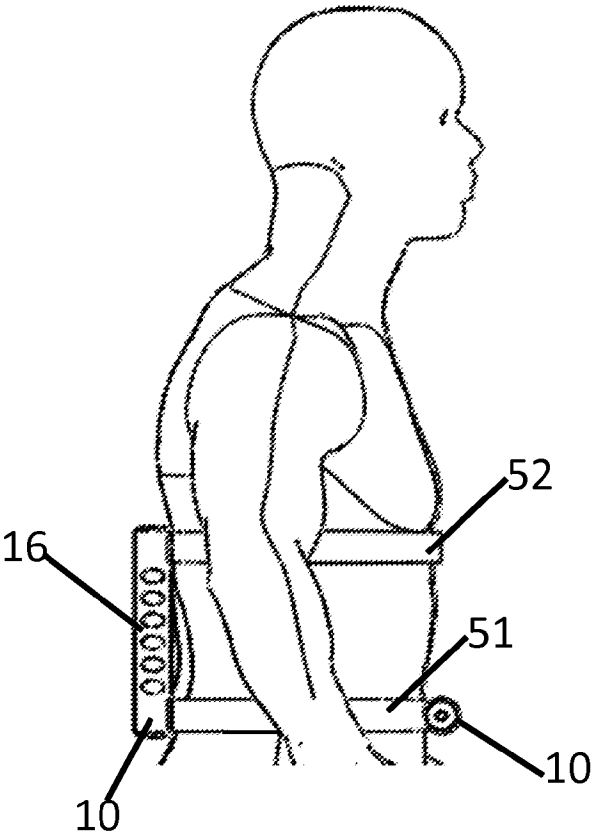
FIG. 4B: A side view of the wearable harness shown in FIG. 4A.

FIGS. 4 and 5 illustrate another embodiment of a provision for releasably attaching Tackle-Bar(s) to a player's body. FIGS. 4A, 4B, and 4C illustrate a harness that includes a frame 50 positioned against a player's lower back region. The harness includes attachment provisions, for example hook-and-loop fasteners, that allow one or more Tackle-Bars 10 to be releasably attached thereto. In the FIG. 4 embodiment, the frame 50 of the harness is attached to the player via means of a waist belt 51 and chest strap 52. FIGS. 4A and 4B illustrate an additional Tackle-Bar 10 releasably attached to the waist belt 51 on the front side of the player. This arrangement places Tackle-Bars 10 on both the front and backsides of the player, thereby providing more options for a defensive player to down the ball carrier.

Figure 5A:
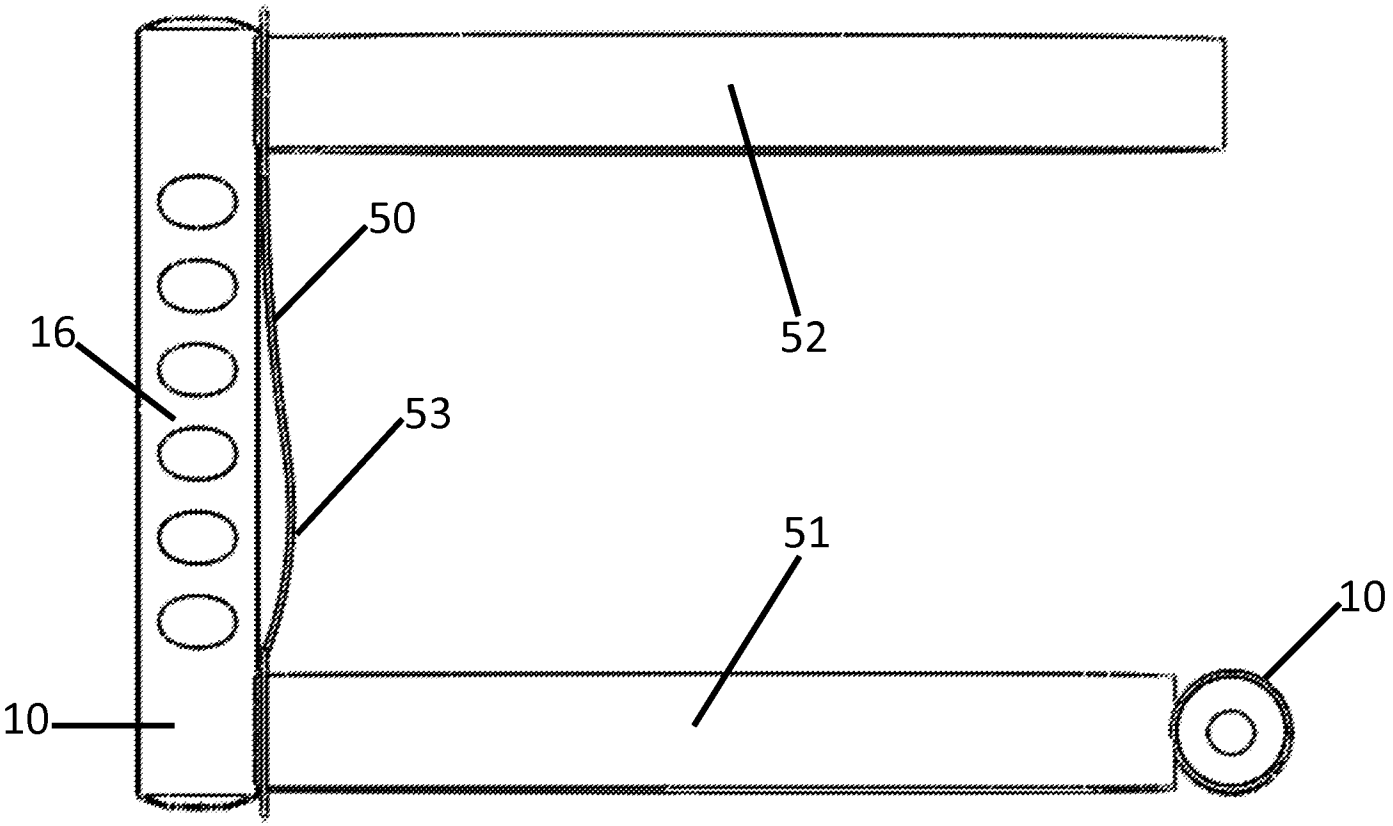
FIG. 5A: A close up side view of the wearable harness of FIG. 4B shown in isolation removed from a ball carrier's torso.
Figure 5B:
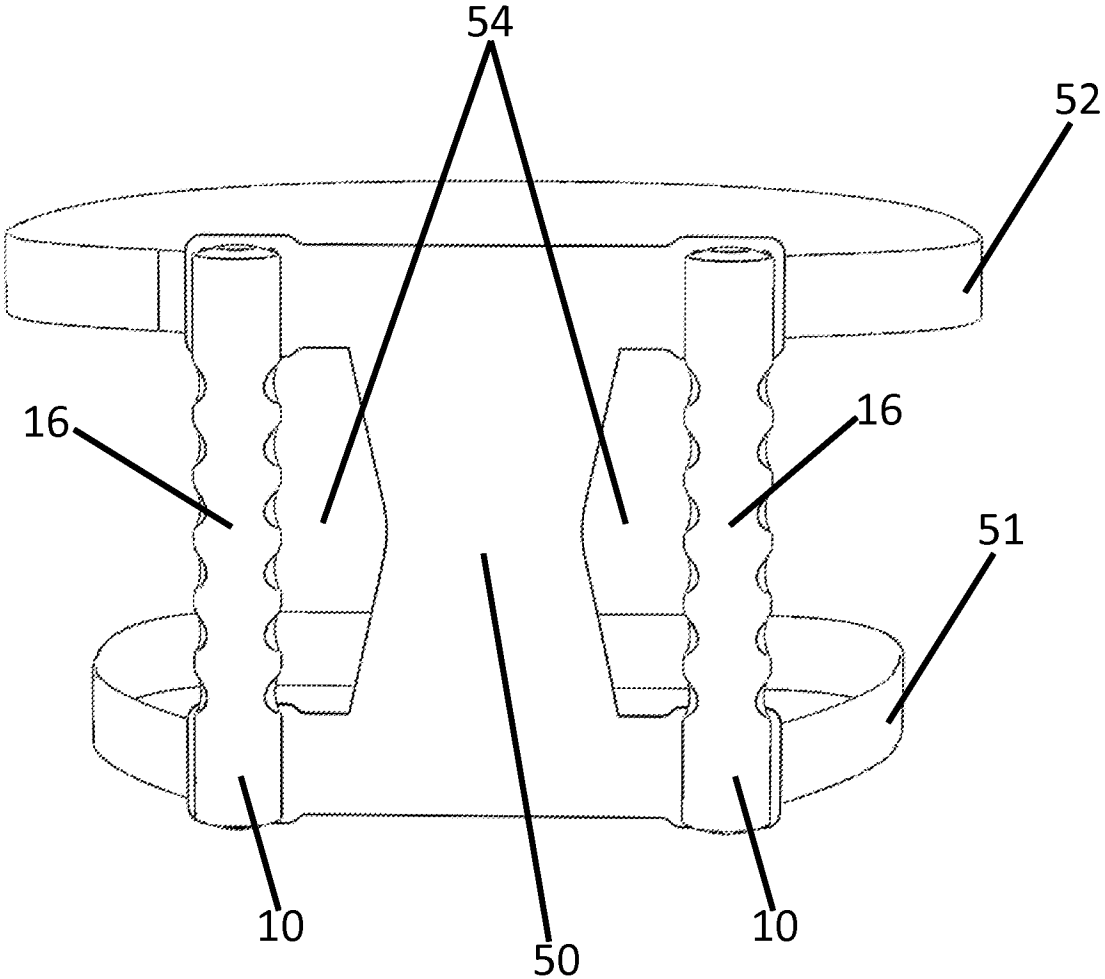
FIG. 5B: A close up back view of the wearable harness of FIG. 4C shown in isolation removed from a ball carrier's torso.
Figure 5C:
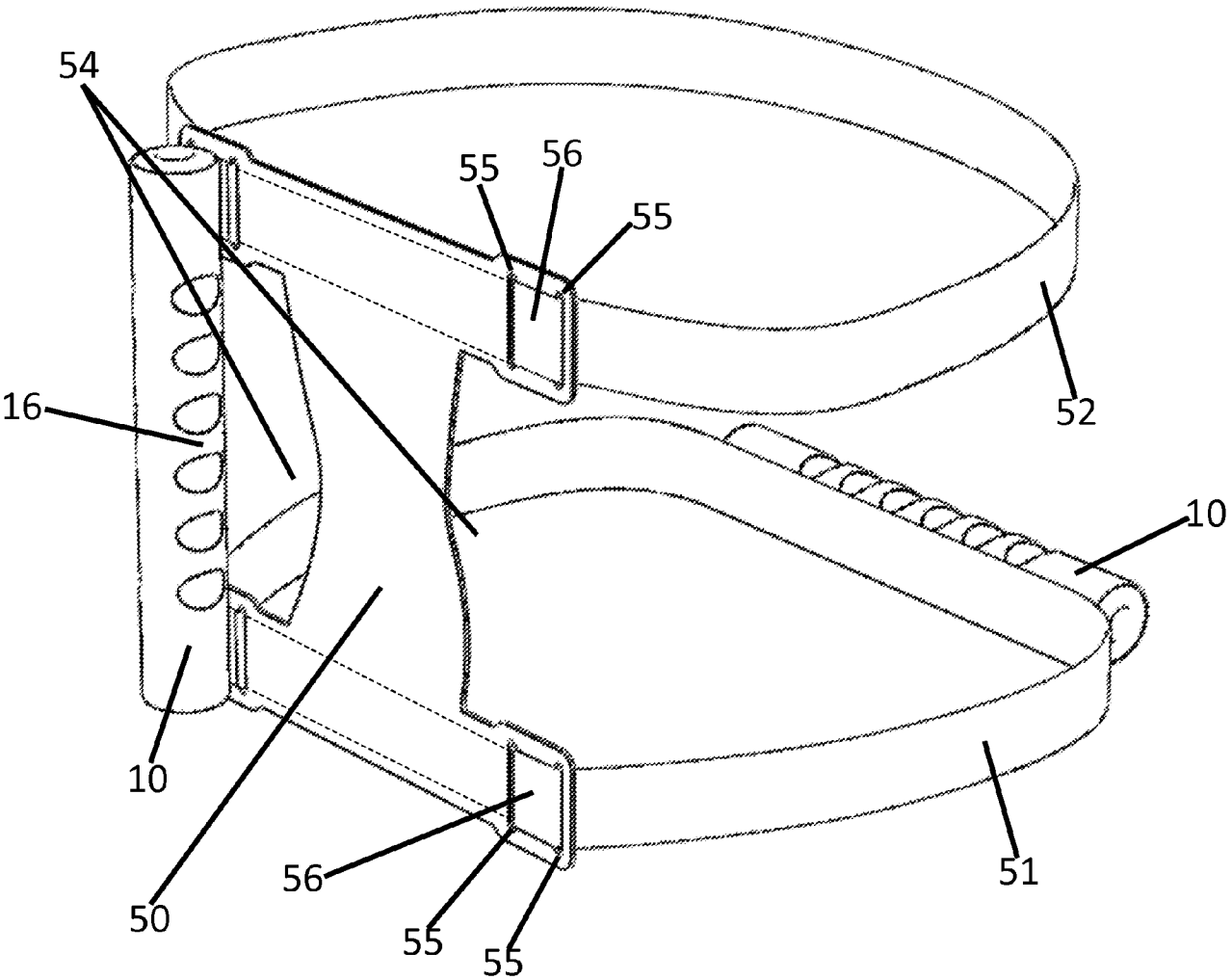
FIG. 5C: A rear perspective view of the wearable harness of FIGS. 5A and 5B shown in isolation removed from a ball carrier's torso.

FIGS. 5A, 5B, and 5C further illustrate details of the embodiment of FIGS. 4A, 4B, and 4C. The frame 50 of the harness, for example, may be made of conformable foam or polymer type materials for fit, comfort, and safety. FIG. 5A further illustrates a lumbar curve feature 53 that helps position and fit the frame 50 against the lower back region of a player. The frame 50 along with the waist belt 51 provides reliable and convenient means for controlling placement and location of Tackle-Bar(s) 10, ensuring that players are consistently wearing the Tackle-Bar(s) 10 in the correct location.

Furthermore, the frame 50 of the harness can position the Tackle-Bar(s) 10 such that they can be easily distinguished while attempting to down the ball carrier. For example, loose fitting shirts or jerseys could conceal, or increase the difficulty in distinguishing, grabbing, and removing a Tackle-Bar 10. It could be common, for example, to inadvertently grab a player's jersey rather than a Tackle-bar in attempting to down the ball carrier. The frame 50 can overcome these difficulties by positioning the Tackle-Bar(s) in a stable, clear, and un-obstructed position. FIGS. 4A and 4B clearly show the Tackle-Bars 10, and in particular the handgrip defined by the body 16, protruding from the player's torso such that they can be easily identified and grasped by the defense during removal. This arrangement is important for minimizing the luck factor in downing the ball carrier. For example, if the Tackle-Bar(s) are difficult to access or grab, the ball carrier could escape despite the defensive player being in a good position to make a play.

FIGS. 5B and 5C further illustrate details of the accessory that position the Tackle-Bar(s) for clear, un-obstructed removal. For example the frame 50 of the harness includes a cut out 54 in the vicinity of each Tackle-Bar 10. The cut out areas 54 of the frame 50 provide further open and clear access for a defensive player to reach in and grab a Tackle-Bar 10.

FIG. 5C illustrates the accessory with one of the Tackle-Bars removed from the harness. As shown, in an embodiment such as the one illustrated, the waist belt 51 and chest strap 52 may not form a permanent or integral part of the harness. The waist belt 51 and the chest strap 52 may be removably attached to the frame 50 to form the harness. As shown, they are threaded through slots 55 in the frame 50, which enables the waist belt 51 and chest strap 52 to be easily removed and replaced. This arrangement facilitates several benefits. Certainly football players come in various shapes and sizes. This embodiment allows the waist belt 51 and chest strap 52 to be swapped out as necessary to accommodate different sized players. Furthermore the waist belt 51 and chest strap 52 may be dual purpose in that they are made from, or include, hook-and-loop fastener material. As shown in FIG. 5C, the slots 55 allow the waist belt 51 and chest strap 52 to thread through the frame 50 in such a way as to present a discrete attachment location 56 for attaching a Tackle-Bar 10. This further ensures the Tackle-Bars can only be connected in a single correct location, providing a type of keying for attachment of the Tackle-Bars. Furthermore, if the hook-and-loop fasteners become worn with use, the waist belt 51 and chest strap 52 can easily be swapped out to provide a new hook-and-loop attachment surface.

The embodiment illustrated in FIGS. 4 and 5 would enable modular use of the accessory. For example, the accessory can be universally applied to various players. By comparison, attaching Tackle-Bar(s) directly to a uniform has inherent challenges. For example the vast variations in jersey sizing and fit can present challenges in consistently placing and locating Tackle-Bars on a player's body. Furthermore, when non-organized youth football games, for example back yard or pick-up style games, are considered, in these contexts, requiring a special shirt, jersey or uniform to facilitate Tackle-bar attachment could be cumbersome compared to utilizing the more universal modular harness accessory for facilitating Tackle-Bar attachment.

As discussed, removal of a Tackle-Bar downs the ball carrier and ends the play. Various technologies could be included in the accessory to help indicate that a Tackle-Bar has indeed been removed and the play is over. For example, removal of a Tackle-Bar could cause a light to illuminate, thereby providing a visual cue that the play is over. The visual cue may also be provided by the difference in the color of the Tackle-Bar(s) and the harness worn on the player.

Similarly a noise, such as a whistle, siren, or even a voice could be triggered by the removal of a Tackle-Bar, again providing a sensory cue to players, referees, and fans that the ball carrier is down and the play is over. Hook-and-loop fasteners make their own distinct sound during removal, and therefore could be another means of providing audible feedback to the players that a Tackle-Bar has been removed. Many other means and methods to provide feedback that a Tackle-Bar has been removed are contemplated by the inventive aspects of the present disclosure.

The Tackle-Bar accessory has thus far been disclosed in the context of American football and more specifically in the context of downing a ball carrier. The accessory is applicable to all types of American football, including padded, non-padded, youth through adult, organized leagues, or backyard pick-up games. The Tackle-Bar accessory could be used as a practice tool, for example placing the Tackle-Bars in strategic locations to teach form-tackling techniques. Additionally the Tackle-Bar accessory could similarly be used to facilitate other games. For example, requiring removal of a Tackle-Bar rather than simply just tagging the person could enhance a basic game of tag. Various other games could similarly leverage the accessory.

Having described the preferred aspects and embodiments of the present disclosure, modifications and equivalents of the disclosed concepts may readily occur to one skilled in the art. However, it is intended that such modifications and equivalents be included within the scope of the claims which are appended hereto.

The invention claimed is:

1. An apparatus for use in an American football type game, comprising:

a plurality of tackle-bars having a generally tubular body, a length extending between two opposing ends, a longitudinal axis extending therebetween, a generally uniform width along the entire length of the tubular body, and a handgrip portion located between the opposing ends; and a harness having a frame, a waist belt and a chest strap;

the frame extending between the waist belt and the chest strap and defining cut-outs adjacent each side of the frame, the cut-outs extending between the waist belt and the chest strap and positioned adjacent at least two of the plurality of tackle-bars, wherein the cut-outs provide access for a player to reach in and grab at least two of the plurality of tackle-bars;

the frame further including a lumbar curve which aids in positioning and fitting the frame against a player's lower back region and a plurality of slots formed in the frame which enable the waist belt and chest strap to be easily removed and replaced from the frame; and a plurality of attachment mechanisms configured for removably receiving the plurality of tackle-bars at attachment points on the frame, such that the plurality of attachment mechanisms are configured to limit movement of the plurality of tackle-bars, the plurality of attachment mechanisms configured to release the plurality of tackle-bars from the plurality of attachment mechanisms when a force that overcomes an attachment force provided by the plurality of attachment mechanisms is applied to the handgrip portion, the plurality of attachment mechanisms also enabling rapid detachable engagement and reengagement of the plurality of tackle-bars to the plurality of attachment mechanisms.

2. The apparatus according to claim 1 wherein the tubular body of the plurality of tackle-bars is generally cylindrical.

3. The apparatus according to claim 2, wherein the handgrip portion includes a plurality of finger grips provided between the opposing ends.

4. The apparatus according to claim 1, wherein the plurality of attachment mechanisms include a hook and loop type fastener that is configured to mate with a hook and loop type fastener provided on the plurality of tackle-bars.

5. The apparatus according to claim 4, wherein the hook and loop type fastener that is configured to mate with the hook and loop type fastener provided on the plurality of tackle-bars is positioned on the waist belt and the chest strap.

6. The apparatus according to claim 5, wherein the waist belt and chest strap both include hook and loop type fasteners that mate with hook and loop type fasteners provided on the plurality of tackle-bars.

7. The apparatus according to claim 1, wherein the frame is formed from a generally rigid polymeric material.

8. An apparatus for use in an American football type game, comprising:

a plurality of tackle-bars having a generally tubular body, a length extending between two opposing ends, a longitudinal axis extending therebetween, a generally uniform width along the entire length of the tubular body, and a handgrip portion located between the opposing ends; and a harness having a frame, a waist belt and a chest strap;

the frame extending between the waist belt and the chest strap and defining cut-outs adjacent each side of the frame, the cut-outs extending between the waist belt and the chest strap and positioned adjacent at least two of the plurality of tackle-bars, wherein the cut-outs provide access for a player to reach in and grab at least two of the plurality of tackle-bars;

the frame further including a lumbar curve which aids in positioning and fitting the frame against a player's lower back region and a plurality of slots formed in the frame which enable the waist belt and chest strap to be easily removed and replaced from the frame;

a plurality of attachment mechanisms configured for removably receiving the plurality of tackle-bars at attachment points on the frame, such that the plurality of attachment mechanisms are configured to limit movement of the plurality of tackle-bars, the plurality of attachment mechanisms configured to release the plurality of tackle-bars from the plurality of attachment mechanisms when a force that overcomes an attachment force provided by the plurality of attachment mechanisms is applied to the handgrip portion, the plurality of attachment mechanisms also enabling rapid detachable engagement and reengagement of the plurality of tackle-bars to the plurality of attachment mechanisms; and an indicator provided between the plurality of tackle-bars and the plurality of attachment mechanisms for indicating when the plurality of tackle-bars have been removed from the plurality of attachment mechanisms.

9. The apparatus according to claim 8, wherein the indicator is configured to provide an audible noise.

10. The apparatus according to claim 9, wherein the indicator is defined at least in part by a hook and loop type fastener of the plurality of attachment mechanisms that is configured to mate with a hook and loop type fastener provided on the plurality of tackle-bars.

11. The apparatus according to claim 8, wherein the indicator is configured to provide a visual cue that the plurality of tackle-bars has been removed from the plurality of attachment mechanisms.

12. The apparatus according to claim 11, wherein the indicator is provided by a color difference between the plurality of tackle-bars and the plurality of attachment mechanisms.

13. The apparatus according to claim 8, wherein the frame is formed from a generally rigid polymeric material.

* * * * *